United States Patent [19]

Zinser

[11] 3,946,964

[45] Mar. 30, 1976

[54] HOSE ROLLER

[76] Inventor: Paul F. Zinser, Box 82, Adams, Decatur County, Ind. 47240

[22] Filed: June 12, 1975

[21] Appl. No.: 586,258

[52] U.S. Cl. ..... 242/86; 242/86.5 R

[51] Int. Cl.[2] ..... B65H 75/38

[58] Field of Search ..... 242/86, 86.1, 86.5, 86.52, 242/96; 137/355.16, 355.12

[56] References Cited

UNITED STATES PATENTS

| | | | |
|---|---|---|---|
| 1,297,380 | 3/1919 | Marriott | 242/86 |
| 2,045,966 | 6/1936 | Ruehmann | 242/86.1 |
| 3,168,260 | 2/1965 | Kittelson | 242/86 |
| 3,357,654 | 12/1967 | Losman | 242/96 |
| 3,810,593 | 5/1974 | Krysi | 242/86.5 R |

*Primary Examiner*—Edward J. McCarthy
*Attorney, Agent, or Firm*—Woodard, Weikart, Emhardt & Naughton

[57] ABSTRACT

An apparatus for rolling a collapsed hose into a roll which includes a frame having a pair of spaced-apart side rails and a crank for rolling the hose between the side rails. One side rail includes a keyed opening which receives the shaft of the crank and an axially extending spaced-apart pin on the shaft when the shaft is in a keyed orientation relative to the opening. The shaft of the crank is borne by both side rails and the axially extending pin cooperates with the shaft to engage a collapsed hose, which is wound about the shaft and pin by cranking a handle portion on the shaft outside the side rails. When the hose is rolled, the shaft and pin are brought into keyed alignment with the opening in one of the side walls and the crank is removed, permitting the rolled hose to be lifted from the frame.

8 Claims, 2 Drawing Figures

HOSE ROLLER

BACKGROUND OF THE INVENTION

1. Field of the Invention

The invention is in the field of winding and reeling, hose carriers.

2. Description of the Prior Art

Various devices have been proposed in the past for rolling a collapsed hose into a roll. Typical devices are shown in U.S. Pat. Nos. 3,168,260 to Kittelson; 2,960,279 to Little; 2,045,966 to Ruehmann; 2,396,451 to Warkentin; and 1,001,208 to Mercer.

In the above-identified patents, the hose rolling devices shown generally do not include guides for both sides of the hose roll, or else mechanisms are required to permit the removal or movement of one of the guide members after the hose is rolled.

SUMMARY OF THE INVENTION

An embodiment of the present invention is an apparatus for rolling a collapsed hose into a roll comprising a frame including a pair of spaced-apart side rails each having an enlarged hose-guide portion, the first of said portions including a shaft-bearing area and the second of the portions including a shaft-bearing area defining an opening and hose-guide means at an end of said side rails for guiding a hose to be rolled, a crank member including a shaft having a first end received at the shaft-bearing area of said first hose-guide portion, a pin spaced-apart from and extending generally axially along a portion of the shaft between the hose-guide portions and having a connecting portion connecting the pin to the shaft, the opening in the second hose-guide portion being keyed to permit passage of the shaft and of the pin and connecting portion when the pin and shaft are oriented in a particular configuration relative to the second hose-guide portion. A crank handle and a collapsed hose engaged by the crank shaft and pin, the hose being rolled around the crank shaft and pin, whereby the crank member may be removed from the frame by proper orientation of the pin relative to the opening in second hose-guide portion after the hose is rolled.

It is an object of the present invention to provide a hose roller apparatus which includes fixed side guides for the hose as it is rolled with a removeable crank shaft member to permit the removal of the hose after it is rolled.

Further objects and advantages of the present invention shall be apparent from the following detailed description and accompanying figures.

DESCRIPTION OF THE PREFERRED EMBODIMENT

Figure 1:
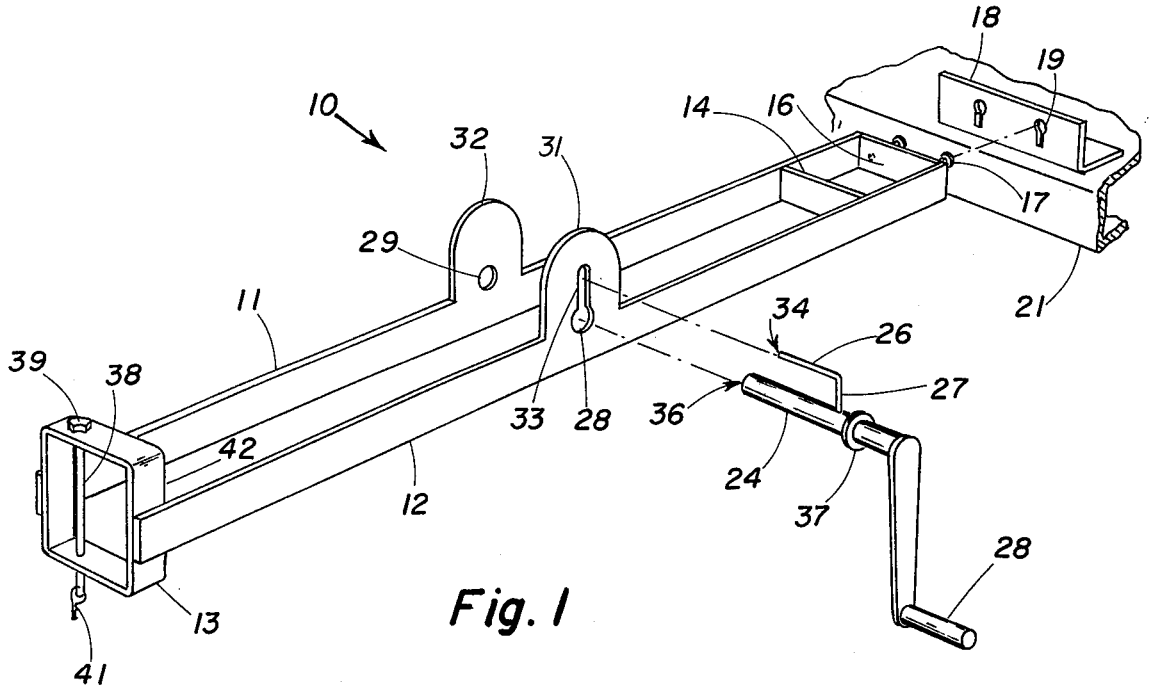
FIG. 1 is an exploded view of an embodiment of the present hose roller invention and showing a mounting bracket on the rear of a fire truck for mounting the frame of the hose roller.

For the purposes of promoting an understanding of the principles of the invention, reference will now be made to the embodiment illustrated in the drawings and specific language will be used to describe the same.

It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now in particular to the figures, there is shown a hose roller apparatus 10 according to the present invention together with a rear portion of a fire truck and mounting means therefor. Hose roller apparatus 10 includes a frame having side rails 11 and 12 and front guide member 13. A rear bar 14 for spacing between the side rails and reinforcement is provided toward the mounting end of rails 11 and 12. Rails 11 and 12 terminate at a rear attachment cross member 16, which threadedly receives a pair of bolts such as 17 which are fixed thereto.

A mounting bracket 18 is rigidly attached to rear bumper 21 of a fire truck shown generally as 22. The heads of bolts 17 are received in key hole slots 19 of bracket 18 and then the frame of the apparatus 10 is dropped into place resting on the top of bumper 21 with the shafts of bolts 17 received in the lower slotted portions of key holes 19. The frame of apparatus 10 may thereby be subsequently removed from mounting bracket 18 by merely lifting the rear portion of side rails 11 and 12 so that the heads of bolts 17 are aligned with the upper wider portions of key holes 19 and the frame pulled away from mounting bracket 18. Other suitable mounting means may alternatively be provided for the frame of apparatus 10.

Figure 2:
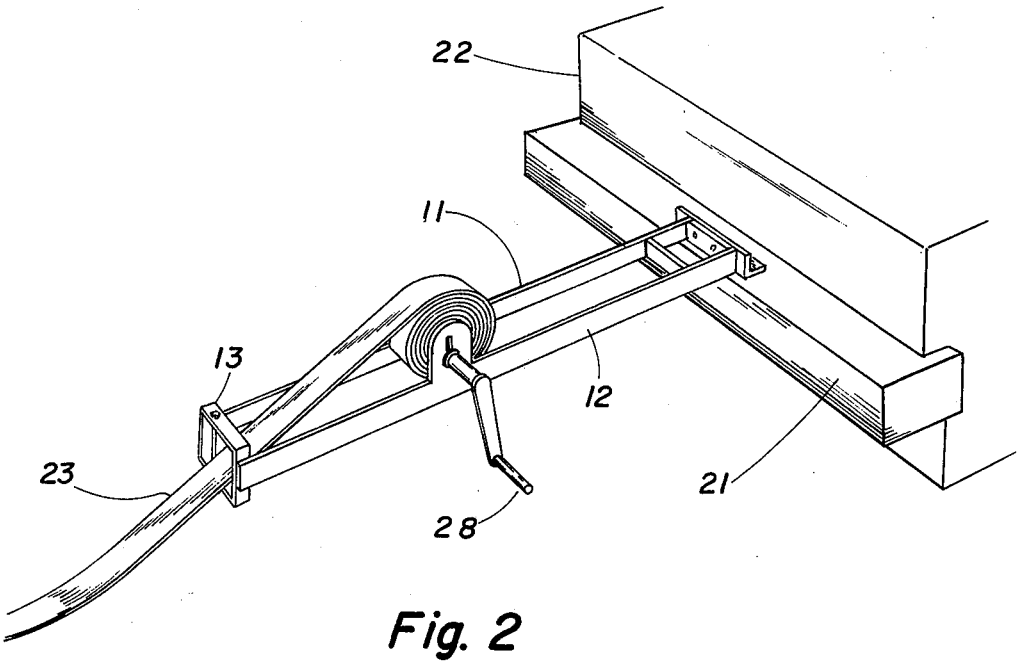
FIG. 2 is a perspective of the apparatus of FIG. 1 shown mounted on the rear portion of a fire truck with a portion of a hose rolled thereon.

A crank member for use with the frame of apparatus 10 is provided to roll a collapsed hose such as 23 (FIG. 2). The crank member includes a crank shaft 24 and an axially extending pin 26 connected to shaft 24 by a connecting portion 27. The crank member further includes a crank handle portion 28 to rotate crank 24 and pin 26 to place hose 23 into a rolled configuration.

To begin a hose rolling operation, crank shaft 24 is inserted through opening 28 and opening 29 in enlarged hose guide portions 31 and 32 of side rails 12 and 11, respectively. In order to insert shaft 24 through openings 28 and 29 pin 26 must be aligned with slot 33 which extends upwardly from opening 28. While end 36 of shaft 24 is received in opening 29 of side rail 11, the end 34 of pin 26 is spaced apart from the inner wall enlarged portion 32 of side rail 11. An annular shoulder 37 is provided to bear against the outer surface of portion 31 to limit the extent of engagement of shaft 24 through openings 28 and 29.

After the crank member is inserted as described above into the frame of apparatus 10, a fire hose is either positioned between pin 26 and shaft 24 at a generally centrally located portion of the hose or the hose coupling at an end of the hose is engaged thereby, as is well known in the art. Obviously then, rotation of crank handle 28 will serve to wind hose 23 onto shaft 24 and around pin 26.

When the hose 23 in entirely wound on shaft 24 and pin 26, crank handle 28 is rotated until pin 26 is again aligned with slot 33, and the crank member is removed from the frame and away from side rails 11 and 12, and the hose 23, now rolled, is removed from between side rails 11 and 12.

Front guide bracket 13 is provided to guide the input of hose 23 as it is rolled on shaft 24. The hose is inserted through bracket 13 as shown in FIG. 2, for rolling. In order to provide a guide for varying widths of hose, a bolt such as 38 is inserted through openings in the top and bottom portions of bracket 13, with head 39 of bolt 38 resting upon the top of bracket 13. A key member 41 is looped through a hole in the bottom of bolt 38 to eliminate accidental removal of bolt 38 from bracket 13. With the bolt in place, as shown in FIGS. 1 and 2, the width between bolt 38 and side wall 42 of bracket 13 is appropriate for the width of hose 23. If a wider hose were to be wound on apparatus 10, retaining member 41 would be removed from the bottom of bolt 38 and bolt 38 removed from bracket 13 to permit the passage of the wider hose.

While there have been described above the principles of this invention in connection with specific apparatus, it is to be clearly understood that this description is made only by way of example and not as a limitation in the scope of the invention.

What is claimed is:

1. Collapsed hose rolling apparatus comprising:

a. a frame including, 1. a pair of spaced-apart side rails each having an enlarged hose-guide portion, the first of said portions including a shaft-bearing area and the second of said portions including a shaft-bearing area defining an opening, and
2. hose-guide means at an end of said side rails for guiding a hose to be rolled;

b. a crank member including, 1. a shaft having a first end received at the shaft-bearing area of said first hose-guide portion,
2. a pin spaced-apart from and extending generally axially along a portion of said shaft between said hose-guide portions and having a connecting portion connecting the pin to the shaft, the opening in the second hose-guide portion being keyed to permit passage of the shaft and of the pin when the pin and shaft are oriented in a particular configuration relative to the second hose-guide portion, and
3. a crank handle; and c. a collapsed hose engaged by the crank shaft and pin, the hose being rolled around the crank shaft and pin, whereby the crank member may be removed from the frame by proper orientation of the pin relative to the opening in said second hose-guide portion after the hose is rolled, freeing the rolled hose from the apparatus.

2. The apparatus of claim 1 which further comprises means for mounting the frame to a fire truck.

3. The apparatus of claim 1 in which the hose guide means comprises a rectangular bracket fixed to the side rails defining an opening through which the hose passes as it is rolled.

4. The apparatus of claim 3 in which the bracket has an apertured top wall and an apertured bottom wall and further comprising a guide piece passing through the apertures in the top and bottom walls of the bracket and removeably mounted therein, the hose being guided between the guide piece and one side wall of the bracket.

5. The apparatus of claim 4 which further comprises means for mounting the frame on a fire truck.

6. The apparatus of claim 5 in which the shaft-bearing area of the first enlarged hose guide portion is defined by an aperture through the hose guide portion.

7. The apparatus of claim 6 in which the shaft includes an annular shoulder received against the outside of the second enlarged hose guide portion.

8. The apparatus of claim 1 in which the second hose-guide portion defines an opening having a circular shaft-receiving portion and an elongated pin-receiving portion.

* * * * *